United States Patent [19]

Noguchi et al.

[11] 4,252,855

[45] Feb. 24, 1981

[54] SURFACE-MODIFIED CELLULOSE ACETATE FILAMENTS AND A PROCESS FOR PRODUCING THE SAME

[75] Inventors: Ryohei Noguchi; Seigi Suzuki; Yutaka Maeda; Koichi Minami, all of Toyama,, Japan

[73] Assignees: Mitsubishi Acetate Co., Ltd; Mitsubishi Rayon Co., Ltd., both of Tokyo, Japan

[21] Appl. No.: 968,037

[22] Filed: Dec. 7, 1978

[30] Foreign Application Priority Data

Dec. 9, 1977 [JP] Japan ..... 52-148528
Feb. 3, 1978 [JP] Japan ..... 53-11836

[51] Int. Cl.[3] ..... B29C 25/00; D02G 3/00

[52] U.S. Cl. ..... 428/400; 8/131; 264/41; 264/45.6; 264/340; 264/343; 428/398

[58] Field of Search ..... 428/364, 376, 398; 264/232, 340, 341, 343, 344, 41, 187, 45.8, 45.9, 45.6; 8/131

[56] References Cited

U.S. PATENT DOCUMENTS

| | | | |
|---|---|---|---|
| 1,939,244 | 12/1933 | Webber et al. | 264/340 |
| 2,088,589 | 8/1937 | Ellis | 264/341 |
| 2,304,632 | 12/1942 | Faelton | 264/340 |
| 2,312,623 | 3/1943 | Brooks et al. | 264/341 X |
| 2,376,890 | 5/1945 | Alles | 428/398 |
| 3,167,385 | 1/1965 | Mann et al. | 264/343 X |
| 3,179,484 | 4/1965 | Tessandori et al. | 264/343 X |
| 3,520,766 | 7/1970 | Newman | 264/344 X |
| 4,008,304 | 2/1977 | Koyama et al. | 264/343 X |

*Primary Examiner*—Lorraine T. Kendell
*Attorney, Agent, or Firm*—Oblon, Fisher, Spivak, McClelland & Maier

[57] ABSTRACT

Surface-modified cellulose acetate filaments having a microporous structure located in the peripheral surface layer thereof are prepared by bringing non-modified cellulose acetate filaments which have an average degree of acetylation of 50 to 62% into contact with an organic solvent which is capable of dissolving or swelling the non-modified filaments and by rapidly evaporating the solvent from the filaments. The microporous structure causes the surface-modified filaments to exhibit a desirable silklike touch and an increased intensity in dye exhaustion of from 1.1 to 2.0 times that of the non-modified filaments.

4 Claims, 8 Drawing Figures

(x 5000)

(x 3000)

(x 5000)

(x 3000)

(x 5000)

SURFACE-MODIFIED CELLULOSE ACETATE FILAMENTS AND A PROCESS FOR PRODUCING THE SAME

FIELD OF THE INVENTION

The present invention relates to surface-modified cellulose filaments or fibers and a process for producing the same. More particularly, the present invention relates to surface-modified cellulose acetate filaments or fibers having a natural silk-like rough touch and dry feel, and an excellent dyeing property, and a process for producing the same.

BACKGROUND OF THE INVENTION

It is known that cellulose acetate filaments or fibers have a good dyeing property, which causes the dyed cellulose acetate filaments or fibers to have a vivid color and a high colorfastness, and a silk-like look, and, therefore, that such filaments or fibers are useful for various products, for example, clothing, especially, fashionable clothing.

Generally, conventional cellulose acetate filaments or fibers are produced by a dry spinning process, in which a spinning solution of a cellulose acetate in an organic solvent, such as acetone, is extruded through a number of spinning holes. The resultant filamentary streams of the cellulose acetate solution are solidified by rapidly evaporating the solvent from the filamentary streams. This evaporation of the solvent is rapidly completed, usually within a period of 0.6 seconds or less. Accordingly, the resultant conventional cellulose acetate filaments or fibers inherently have a smooth and soft touch, and a greasy feel, but not a natural silk-like rough and rigid touch, and dry feel. Accordingly, the conventional cellulose acetate filaments or fibers are useless for producing, for example, fashionable clothing which exhibits a natural silk-like rough and rigid touch and dry feel.

In order to modify the touch of the conventional cellulose acetate filaments or fibers, a number of approaches have been attempted.

In one approach for modifying the conventional cellulose acetate filaments or fibers so as to exhibit a natural silk-like rough and rigid touch, and dry feel, a pigment, for example, titanium oxide, blended to a cellulose acetate flakes and the blend was subjected to a fiber-forming process. However, this approach was not successful because the resultant filaments or fibers exhibited a poor mechanical strength, and therefore, were useless for practical use.

In another approach, the cellulose acetate to be converted into filaments or fibers were chemically modified with, for example, hydrolysis. This approach also resulted in a poor mechanical property of the filaments or fibers.

In still another approach, the filaments or fibers were produced from a blend of two or more types of cellulose acetate flahes which were different in acetyl value from each other. However, this approach also caused the resultant filaments or fibers to exhibit a poor mechanical property.

SUMMARY OF THE INVENTION

The object of the present invention is to provide surface-modified cellulose acetate filaments or fibers having a natural silk-like rough touch and dry feel, and a mechanical property similar to that of conventional cellulose acetate filaments or fibers, and a process for producing the same.

The above-mentioned object can be attained by the surface-modified cellulose acetate filaments or fibers of the present invention which have an average degree of acetylation of from 50 to 62%, each individual filament or fiber having at least one microporous structure located in the peripheral surface layer of the filament or fiber, which microporous structure has been prepared by treating a peripheral surface of a non-modified cellulose acetate filament or fiber with an organic solvent and which causes the surface-modified filament or fiber to have an intensity in dye exhaustion of from 1.1 to 2.0 times that of the non-modified filament or fiber.

The above-mentioned surface modified cellulose acetate filaments or fibers can be produced by the process of the present invention which comprises the steps of:

bring the peripheral surface of non-modified cellulose acetate filaments or fibers having an average degree of acetylation of from 50 to 62% into contact with an organic solvent capable of dissolving or swelling the non-modified filaments or fibers, and;

rapidly evaporating the solvent from the filaments or fibers to form at least one microporous structure in the peripheral surface layer of each individual filament or fiber, the microporous structure causing the resultant surface-modified filament or fiber to exhibit an intensity in dye exhaustion of from 1.1 to 2.0 times that of the non-modified filament or fiber.

DETAILED DESCRIPTION OF THE INVENTION

The term "filaments" used hereinafter refers to filaments in the form of continuous multifilaments, monofilaments or filament tow or staple fibers.

Figure 1B:
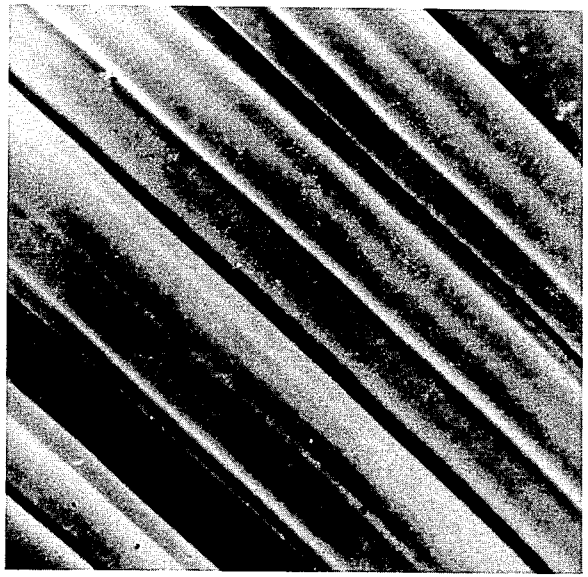
FIG. 1B is a photograph showing an electron microscopic view in a magnification of 3000 of a peripheral surface of the non-modified cellulose acetate fiber shown in FIG. 1A.
Figure 1A:
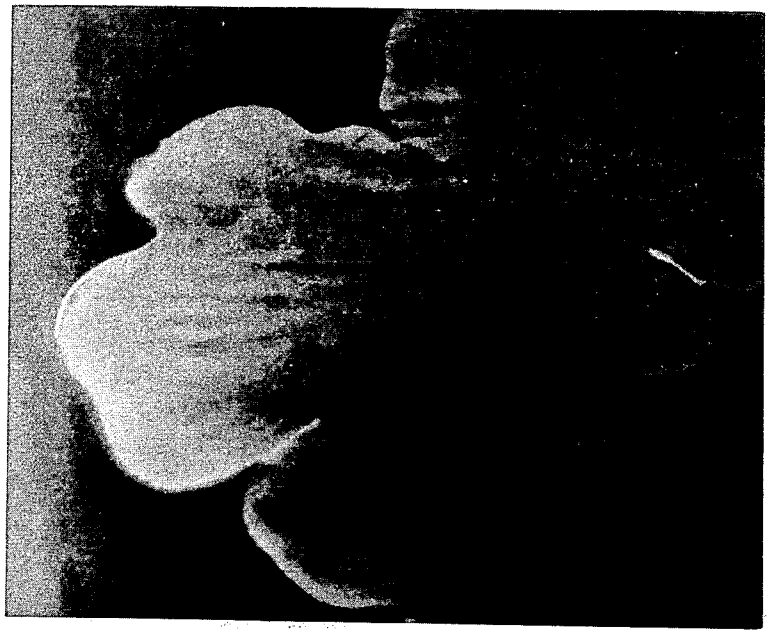
FIG. 1A is a photograph showing a cross-sectional electron microscopic view of a non-modified cellulose acetate fiber at a magnification of 5000.

Referring to FIGS. 1A and 1B, it is observed that the peripheral surface of the conventional (non-modified) cellulose acetate filament is smooth and the peripheral surface layer has no pores. The smooth surface causes the conventional cellulose acetate filament to exhibit a greasy touch, and no natural silk-like rough and rigid touch, and dry feel.

Figure 3:
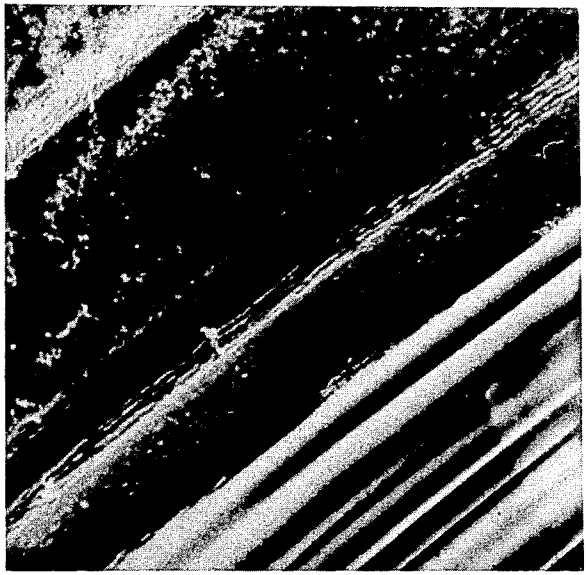
FIG. 3 is a photograph showing an electron microscopic view, at a magnification of 3000, of a peripheral surface of the surface-modified cellulose acetate fiber shown in FIG. 2.
Figure 2:
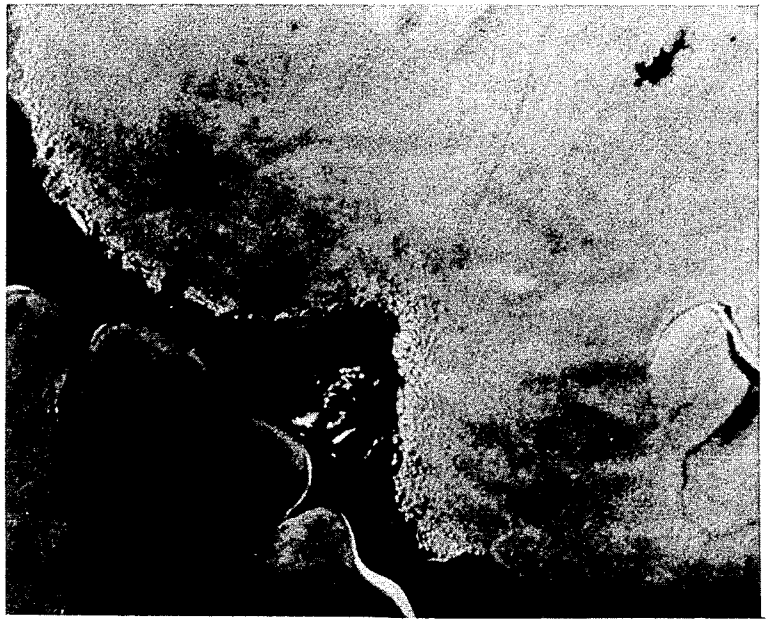
FIG. 2 is a photograph showing an electron microscopic view at a magnification of 5000, of a cross-sectional profile of a surface-modified cellulose acetate fiber of the present invention.

Referring to FIGS. 2 and 3, the surface modified cellulose acetate filament is provided with a microporous structure located in the peripheral surface layer of the filament. This structure contains therein numerous extremely fine pores. This microporous structure causes the surface-modified cellulose acetate filaments of the present invention to exhibit the desirable natural silk-like rough and rigid touch, and dry feel, and to have an intensity in dye exhaustion of from 1.1 to 2.0 times that of the non-modified cellulose acetate filaments from which the surfacemodified fibers have been converted.

The surface-modified cellulose acetate filaments of the present invention have an average degree of acetylation of 50 to 62%. This is because the surface-modified filaments of the present invention are obtained by the modification of the non-modified cellulose acetate filaments having an average degree of acetylaton of 50 to 62% and the modification does not result in a change in the average degree of acetylation. The cellulose acetate having an average degree of acetylation either larger than 62% or smaller than 50% has a poor fiber-forming property and the resultant filaments have poor mechanical properties. The surface-modified cellulose acetate filaments of the present invention have an intensity in dye exhaustion of from 1.1 to 2.0, preferably, 1.2 to 1.8 times, that of the non-modified cellulose acetate filaments which have been converted into the surface-modified filaments.

The term "intensity in dye exhaustion" used herein refers to a dyeing property of the cellulose acetate filaments which is determined by the following method.

(1) When the cellulose acetate filaments consist of cellulose diacetate, the filaments are dyed by using a dyeing liquid containing Dianix Blue FG-SE, which is a trademark of C.I. Disperse Blue, made by Mitsubishi Kasei, Japan, in an amount of 2% based on the weight of the filaments, in a liquor ratio of 1:100, at a temperature of 93° C., for 60 minutes. The amount of the dye exhausted by the filaments is measured. The intensity in dye exhaustion of the filaments is calculated in accordance with the equation:

$$\text{Intensity in dye exhaustion (\%)} = \frac{\text{Amount of dye exhausted by filaments or fibers}}{\text{Amount dye in dyeing liquid}} \times 100$$

(2) When the cellulose acetate filaments consist of cellulose triacetate, the intensity in dye exhaustion is determined in the same manner as that mentioned above, except that Cibacet Blue F-3R, which is a trademark of C.I. Disperse Blue, made by Ciba-Geigy, Switzerland, is used in place of Dianix Blue FG-SE.

When the intensity in dye exhaustion of the surface-modified cellulose acetate filaments is less than 1.1 times that of the non-modified cellulose acetate filaments, the surface-modified filaments have a poor natural silk-like touch and feel. Also, an intensity in dye exhaustion more than 2.0 times that of the non-modified cellulose acetate filaments causes the surface-modified filaments to exhibit significantly decreased mechanical properties. It is important that the microporous structure be located only in the peripheral surface layer of the individual filament or fiber, and the position other than the peripheral surface layer of the individual surface-modified filament have the same structure as that of the individual non-modified filaments. This is because the modification of the middle and center portions of the fiber results in a decrease in the mechanical strength of the filament.

In each individual surface-modified cellulose acetate filament of the present invention, the microporous structure may be formed either in the entire peripheral surface of the filament or in a portion or a plularity of portions of the peripheral surface layer of the filament. In the latter case, one microporous structure may, be formed continuously along the longitudinal axis of the filament, but must not completely cover the entire area of the peripheral surface of the filament. Also, a plurality of microporous structures may be formed discontinuously along the longitudinal axis of the filament. In the case where the microporous structure or structures are formed in a portion or portions of the peripheral surface layer of the individual filament, it is preferable that the total surface area of the microporous structure or structures correspond to 0.3 to 10% or 90 to 99.7% of the entire area of the peripheral surface of te surface-modified filament. In this case, the surface modified filaments can exhibit a special dyeing effect due to the difference in dyeing property between the surface-modified portions and the non-modified portions of the filaments surface.

The surface-modified cellulose acetate filaments of the present invention are produced by bringing the peripheral surfaces of non-modified cellulose acetate filaments having an average degree of acetylation of from 50 to 62% into contact with an organic solvent capable of dissolving or swelling the non-modified filaments, and; then, by rapidly evaporating the solvent from the filaments. This process results in the formation of the microporous structure or structures in the peripheral surface layer of each individual filament, and causes the resultant surface modified filaments to exhibit an intensity in dye exhaustion of from 1.1 to 2.0 times that of the non-modified filaments.

The microporous structure layer in each surface-modified cellulose acetate filament of the present invention has a thickness of about 5 microns, preferably, 0.5 to 3 microns, and contains a great number of micropores each having a size of 1000 angstroms or less, preferably, 500 angstroms or less, more preferably, 100 angstroms or less.

Figure 4:
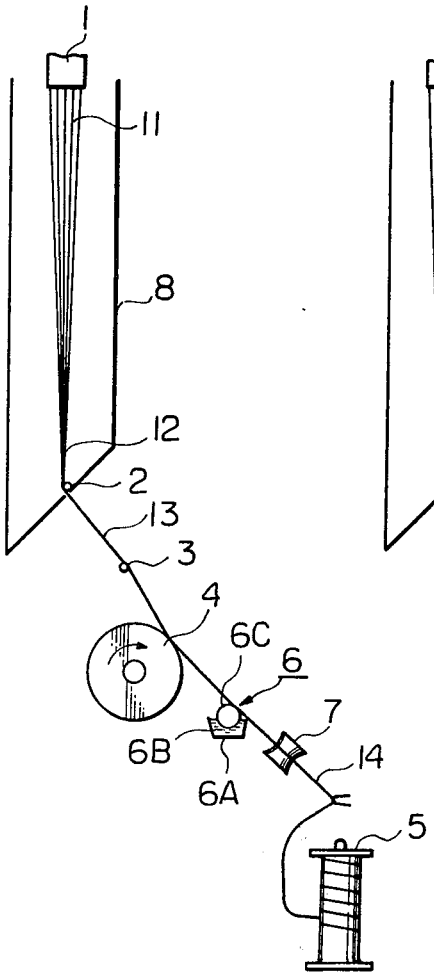
FIG. 4 is an explanatory view of an apparatus for effecting the process of the present invention.

The surface-modified filaments of the present invention may be produced by using an apparatus shown in FIG. 4. Referring to FIG. 4, a spinning solution of a cellulose acetate in a solvent is extruded into a spinning chimney 8 through a number of spinning holes in a spinneret 1 so as to form a number of filamentry streams 11 of the spinning solution. During the time the filamentary streams 11 travel within the spinning chimney 8, they are solidified by evaporating the solvent from the streams 11, so as to form a number of individual non-modified cellulose acetate filaments 12. The non-modified filaments are bundled by a guide roller 2 to form multifilaments 13. The non-modified multifilaments 13 are taken up by a take-up roller 4, having a large diameter, through a guide roller 3, by which an oiling liquid (not shown) is applied to the filaments, and then, fed into a surface-modifying process. A device 6 for supplying a solvent onto the peripheral surfaces of the non-modified multifilaments 13 comprises a vessel 6A for containing the solvent 6B and a rotatable roller 6C, the lower portion of which is immersed in the solvent 6B in the vessel 6A. When the roller 6C is rotated, the solvent 6B is spread on the entire peripheral surface of the roller 6C. The non-modified filaments 13 are brought into contact with an upper portion of the peripheral surface of the roller 6C, so as to transfer the solvent onto the entire area or a portion or portions of the peripheral surfaces of each individual filament 13.

The solvent to be applied to the non-modified cellulose acetate should be capable of dissolving or swelling the cellulose acetate and may be selected from the group consisting of aceton, mixtures of 30% by weight or more of acetone and 70% by weight or less of water, mixtures of 30% by weight or more of acetone and 70% or less of methyl alcohol, dimethylformamide, methylene chloride, mixtures of 20% by weight or more of methylene chloride and 80% by weight or less of methyl alcohol and tetrahydrofuran. The most preferable solvent for the process of the present invention is an acetone-containing solvent or a methylene chloride-containing solvent.

The rotatable roller may have a smooth peripheral surface which is suitable for forming a continuous microporous structure on the penipheral surface along the longitudinal axis of the individual filament. The rotatable roller may have a gear-like peripheral surface which is proper for forming a number of discontinuous microporous structures in the peripheral surface layer along the longitudinal axis of the filament.

Figure 5:
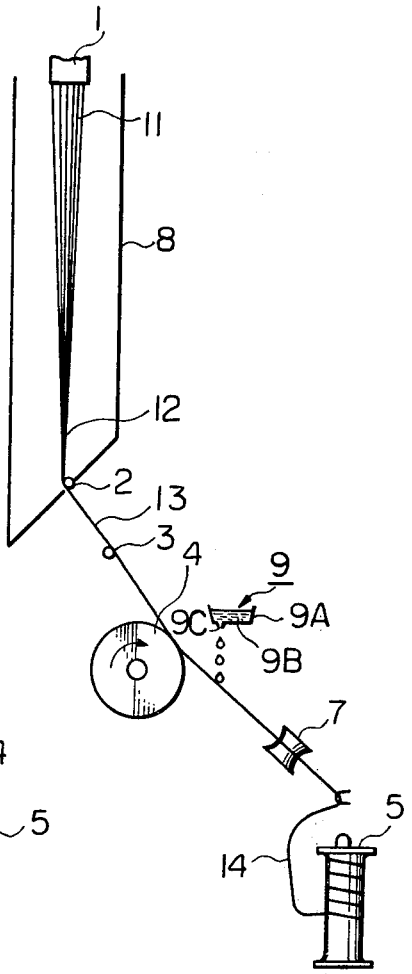
FIG. 5 is an explanatory view of another apparatus for carrying out the process of the present invention.

The contact of the non-modified filaments with the solvent may be carried out by dropping the solvent toward the non-modified filaments. Referring to FIG. 5, a device 9 for applying a solvent 9B onto the non-modified filaments 13 comprises a vessel 9A for containing the solvent 9B and means 9C for dropping the solvent from the vessel 9A.

The contact of the non-modified filaments with the solvent may be carried out by spraying the solvent toward the non-modified filaments. For this purpose, any conventional spraying device can be utilized.

The solvent is applied to the non-modified filaments preferably at its boiling point or lower, more preferably, at ambient temperature.

Next referring to FIGS. 4 and 5, the multifilaments 13 is forwarded into a device 7 for evaporating the solvent from the multifilament 13 so as to complete the modification of the filament. The device 7 may consist of a dryer oven, in which drying air is circulated, or may have means for blowing drying air toward the multifilament 13, for example, a air jet nozzle. The evaporation is preferably carried out at a temperature of 60° C. or less, more preferably, from ambient temperature to 60° C. An evaporating temperature higher than 60° C. will result in the re-formation of a smooth peripheral surface of the filament.

Next, the resultant surface-modified filaments 14 are wound on a bobbin 5. The winding operation may be effected in a drying air atmosphere by using a spindle 5, as shown in FIGS. 4 and 5. In this case, the evaporating device 7 may be omitted and the spindle 5 is rotated at a speed of 2500 turns/min or more, so as to cause the filaments to exhibit a balooning motion. This motion is effective for completing the evaporation of the solvent from the filaments.

In the solvent-contacting and evaporating operations, it is preferable that the period of time from a stage at which the non-modified filaments come into contact with the solvent to a stage at which the evaporation of the solvent is substantially complete be is 0.2 second or less, more preferably, 0.06 second or less. A contact time more than 0.2 second will result in the formation of a very thick microporous structure which causes the resultant surface-modified filaments to exhibit a poor mechanical strength.

For this purpose, in a preferable embodiment of the process of the present invention, the non-modified filaments are supplied at a speed of 300 m/second or more to the solvent-contacting device. The distance between the solvent-contacting device and an outlet of the evaporating device is 2 m or less, more preferably, 0.6 m or less.

The surface-modified cellulose acetate filaments may be used alone or in the form of a mixture yarn, wherein the cellulose acetate filaments are incorporated with at least one different type of filaments, for example, polyester filaments or polyamide filaments. Also, the surface-modified cellulose acetate staple fibers of the present invention can be used alone or in the form of a blend with at least one type of different fibers, for example, polyester or polyamide staple fibers. The surface-modified cellulose acetate filaments or fibers of the present invention can be utilized to produce various clothings, for example, ladies suits, blouses and one piece dresses.

The following examples are given only for the purpose of illustrating in detail the present invention. All quantities shown in the examples are on a weight basis unless otherwise indicated.

EXAMPLES 1 AND 2 AND COMPARATIVE EXAMPLE 1

In each of Examples 1 and 2 and Comparative Example 1, an apparatus of the type shown in FIG. 4 was used for producing surface-modified cellulose triacetate filaments.

In Example 1, a spining solution of 21.9% of cellulose triacetate flakes having an average degree of acetylation of 61.2% in methylene chloride was extruded through 34 spining holes in a spinneret into a spining chimney into which drying air was blown at a temperature of 76° C. The solidified non-modified filaments having yarn count of 200 denier/34 filaments were taken up at a speed of 570 m/min. by a take-up roller through a bundling guide roller and an oiling roller. The non-modified cellulose acetate filaments had a tensile strength of 1.21 g/d and an ultimate elongation of 32%. The non-modified cellulose acetate filaments also exhibited an electron microscopic view of its cross-sectional profile as shown in FIG. 1A at a magnification of 5000. And an electron microscopic view of its peripheral surface as shown in FIG. 1B at a magnification of 3000.

The non-modified cellulose triacetate filaments were fed under tension of 7 g at the same speed as that mentioned above into a solvent-contacting device. In this device, an amount of 7 g/sec of methylene chloride was, held by the peripheral surface of the filaments at ambient temperature. The solvent-holding filaments were fed into an evaporating device in which drying air was blown onto the filaments under a guage pressure of 2.0 kg/cm$^2$ at a temperature of 25° C. and then, the resultant surface-modified filaments were fed into a spindle which rotated at a speed of 5500 turns/minutes at ambient temperature. The solvent-holding period from the stage at which the solvent was applied to the filaments in the solvent-contacting device to the stage at which the solvent was substantially completely evaporated from the filaments in the evaporating device was 0.03 seconds. The resultant surface-modified cellulose triacetate filaments had a tensile strength of 1.20 g/d and an ultimate elongation of 29%.

The resultant surface-modified cellulose triacetate filaments exhibited an electron microscopic view of its cross-sectional profile as shown in FIG. 2 at magnification of 5000 and an electron microscopic view of its peripheral surface as shown in FIG. 3 at a magnification of 3000.

Figure 6:
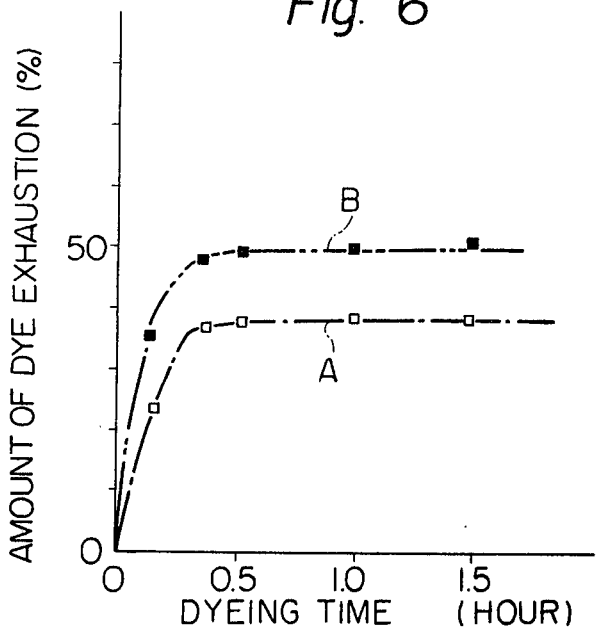
FIG. 6 is a graph showing intensities in dye exhaustion of non-modified cellulose triacetate filaments and surface-modified cellulose triacetate filaments of the present invention derived from the above non-modified filaments.

The above-obtained non-modified filaments were dyed in a dyeing both containing Cibacet Blue F-3R in an amount of 2.0% based on the weight of the filaments in a liquor ratio of 1:100 at a temperature of 93° C. The amounts of the dye exhausted by the filaments in percent based on the initial amount of the dye in the dyeing bath were measured during dyeing periods of 10, 20 and 30 minutes, and 1 and 1.5 hours. The results are shown in Curve A in FIG. 6.

The same dyeing test as that mentioned above was applied to the above-obtained surface-modified cellulose triacetate filaments. The results are shown in Curve B in FIG. 6. From FIG. 6, it is clear that the intensities in dye exhaustion of the non-modified filaments and the surface-modified filaments were determined to be 38% and 49%, respectively. Accordingly, the intensity in exhaustion of the surface-modified filaments was 1.29 times that of the non-modified filaments. The resultant filaments each had a microporous structure layer having a thickness of about 1.0 micron and containing a large number of micropores each having a size of 100 angstroms or less.

Both the non-modified filaments and the surface-modified filaments obtained above were separately converted into a knitting having a plain stitch structure. It was observed that the surface-modified filament knitting had a natural silky knit-like rough and rigid touch. However the non-modified filament knitting exhibited a greasy touch.

In Comparative Example 1, the same procedures as those mentioned in Example 1 were repeated, except that the solvent-contacting and evaporating operations were carried out at a filament speed of 250 m/min. However, during the process, it was observed that the filaments frequently adhered to each other and were broken.

In Example 2, procedures identical to those mentioned in Example 1 were carried out, except that the solvent-holding filaments were directly fed into a spindle which was located at a distance of 30 cm from the solvent contacting device, and the filaments were rotated at a speed of 3000 turns/min. at a temperature of 33° C., without using any evaporating device. The solvent-holding period of the filaments was 0.06 seconds. The intensity in dye exhaustion of the resultant surface-modified filaments was 1.29 times that of the non-modified filaments. The microporous structure layers in the resultant surface-modified filaments had a thickness ranging from 0.1 to 1.0 microns. The surface-modified filament knitting exhibited a desirable natural silklike, rough and rigid touch.

EXAMPLES 3 AND 4 AND COMPARATIVE EXAMPLE 2

In each of Examples 3 and 4 and Comparative Example 2, an apparatus of the type as shown in FIG. 5 was used for producing surface-modified cellulose diacetate filaments.

In Example 1, a spining solution of 26.8% of cellulose diacetate flakes having an average degree of acetylation of 55% in acetone was extruded through 36 spinning holes in a spinneret, into a spinning chimney in which drying air was blown at a temperature of 78° C. The solidified non-modified filaments having a yarn count of 150 denier/36 filaments were taken up by a take-up roller at a speed of 540 m/min. through a bundling guide roller and an oiling roller. The resultant non-modified cellulose diacetate filaments had a tensile strength of 1.17 g/d and an ultimate elongation of 33%. The same dyeing test as that mentioned in Example 1 was applied to the non-modified filaments, eccept that Dianix Blue FG-SE was used in place of Cibacet Blue F-3R. The results are shown in Curve C in FIG. 7.

The non-modified filaments were forwarded under a tension of 7 g into a solvent-contacting device as shown in FIG. 5. In this device, a solvent consisting of acetone was dropped at a rate of 0.4–0.5 g/second on the non-modified filaments. Next, the solvent-holding filaments were fed into an evaporating device in which hot drying air was blown toward the filaments at a temperature of 60° C. under gauge pressure of 2.0 kg/cm$^2$. The solvent-holding period was 0.03 seconds. The resultant surface-modified filaments had a tensile strength of 1.17 g/d and an ultimate elongation of 31%. The same dyeing test as that mentioned above was applied to the surface-modified filaments. The results are shown in Curve D in FIG. 7.

Figure 7:
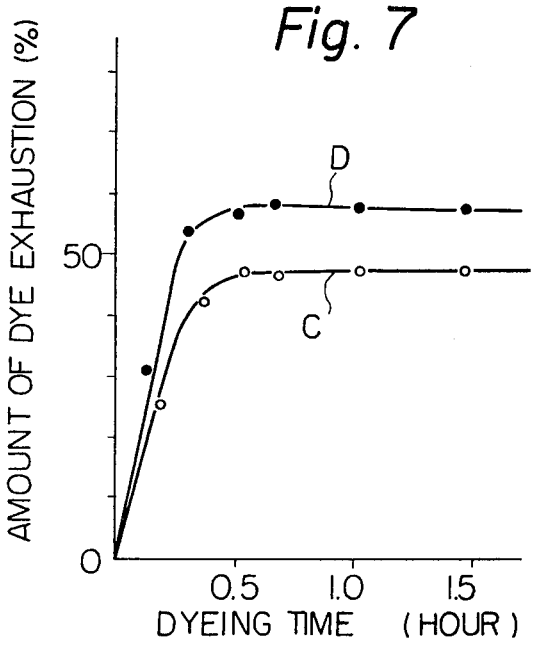
FIG. 7 is a graph showing intensities in dye exhaustion of non-modified cellulose diacetate filaments and surface-modified cellulose diacetate filaments of the present invention derived from the above non-modified filaments.

From FIG. 7, it is clear that the intensity in dye exhaustion of the surface-modified filaments was 57% and that of the non-modified filaments was 47%. The microporous structure layers in the resultant surface-modified filaments had a thickness of 0.5 microns or less. Accordingly, the intensity in dye exhaustion of the surface-modified filaments was 1.21 times that of the non-modified filaments.

The knitted fabric from the surface-modified filament yarn exhibited a desirable natural silklike touch whereas a knitting prepared from the non-modified filaments exhibited a greasy touch.

In comparative Example 2, the same procedures as those mentioned in Example 3 were repeated, except that the solvent-contacting and evaporating operations were carried out at a filament speed of 250 m/min. The intensity in dye adsorption of the resultant surface-modified filaments was 1.31 times that of the non-modified filaments. However, it was observed that during the process, the filaments often adhered to each other and were broken.

In Example 4, the same procedures as those mentioned in Example 3 were carried out, except that the solvent was dropped at a rate of 0.8 to 1.0 g/second and the solvent-holding filaments were directly fed into a spindle so as to evaporate in the same manner as that mentioned in Example 2.

The resultant surface-modified filaments had a tensile strength of 1.15 g/d and an ultimate elongation of 32%, and exhibited an intensity in dye exhaustion of 1.27 times that of the non-modified filaments.

In the surface-modified filaments, it was observed that the microporous structures were formed in lengths of from about 4 to about 8 cm per 4 m of filaments. That is, the total area of the microporous structures corresponds to 1–2% of the entire peripheral surface area of the filaments.

A knitting prepared from the surface-modified filaments was dyed in the same manner as that mentioned in Example 3. The dyed knitting exhibited a proper sprinkled color effect and a desirable natural silklike touch.

EXAMPLES 5 and 6

In Example 5, the same procedures for producing cellulose triacetate filaments as those mentioned in Example 1 were carried out except that the spinneret had 33 spinning holes and the resultant multifilament yarn had a yarn count of 120 denier/33 filaments. A polyethylene terephthalate multifilament yarn having a yarn count of 30 denier/24 filaments was fed into the spining chimney and incorporated into the cellulose triacetate multifilament yarn so as to provide a mixed filament yarn.

The mixed filament yarn was fed at a speed of 600 m/min. to the solvent-contacting and evaporating steps by using the apparatus shown in FIG. 4.

A dyed knitting prepared from the mixed filament yarn containing the surface-modified cellulose triacetate filaments exhibited a proper regid and rough touch.

In Example 6, the same procedures as those mentioned in Example 5 were carried out, except that the solvent was dropped in an amount of 0.6 to 0.8 g/second onto the mixed filament yarn by using the solvent-contacting device as shown in FIG. 5. The total length of each of the microporous structures located on each individual surface-modified cellulose acetate filament was in a range of from 4 to 8 cm per 6 m of the filament.

A dyed knitting prepared from the mixed filament yarn containing the surface-modified cellulose acetate filaments exhibited a proper sprinkled color effect and a desirable rigid and rough touch.

Waht we claim is:

1. Surface-modified cellulose acetate filaments or fibers having an average degree of acetylation of from 50 to 62%, each individual filament or fiber having at least one microporous structure located in the peripheral surface layer of said filament or fiber, said microporous structure having a thickness of about 0.5 to about 5 microns and the pores thereof having a size not greater than about 1000 Angstroms, said microporous structure having been prepared by contacting the peripheral surface of a non-modified cellulose actate filament or fiber with an organic solvent capable of dissolving or swelling said non-modified filaments or fiber and subsequently rapidly evaporating said solvent from said filament or fiber whereby said solvent is in contact with said surface for a period of time not greater than 0.5 seconds, whereby the surface-modified filament or fiber acquires an intensity in dye exhaustion of from 1.1 to 2.0 times that of said non-modified filament or fiber.

2. Surface-modified cellulose acetate filaments or fibers as claimed in claim 1, wherein said dye exhaustion intensity of said surface-modified filament is in a range of from 1.2 to 1.8 times that of said non-modified filament.

3. Surface-modified cellulose acetate filaments or fibers as claimed in claim 1, wherein a plurality of said microporous structures are located discontinuously in the surface of said surface-modified filament.

4. Surface-modified cellulose acetate filaments or fibers as claimed in claim 3, wherein said microporous structures have a total surface area corresponding to 0.3 to 10% or 90 to 99.7% of the entire area of said peripheral surface of said filament or fiber.

* * * * *